US005967183A

United States Patent [19]

Detweiler et al.

[11] Patent Number: 5,967,183

[45] Date of Patent: Oct. 19, 1999

[54] CONTROLLING VAPOR FLOW IN A CONDUIT

[75] Inventors: Charles A. Detweiler, Durand; Daniel L. DeLand, Davison; Barbara J. Erickson, Holly; Gerrit V. Beneker, Algonac, all of Mich.

[73] Assignee: Eaton Corporation, Cleveland, Ohio

[21] Appl. No.: 09/006,266

[22] Filed: Jan. 13, 1998

[51] Int. Cl.[6] ..... F17C 13/00

[52] U.S. Cl. ..... 137/614.2; 137/587; 137/571

[58] Field of Search ..... 137/614.2, 907, 137/587, 571; 123/519, 520, 516

[56] References Cited

U.S. PATENT DOCUMENTS

| | | | |
|---|---|---|---|
| 4,149,504 | 4/1979 | Walters | 137/66 |
| 4,175,527 | 11/1979 | Sanada et al. | 123/136 |
| 4,212,276 | 7/1980 | Kaneda | 123/516 |
| 4,436,112 | 3/1984 | Atkins et al. | 137/510 |
| 4,458,650 | 7/1984 | Kessler et al. | 137/510 |
| 4,679,580 | 7/1987 | Devall et al. | 137/39 |
| 5,056,494 | 10/1991 | Kayanuma | 137/588 |
| 5,083,546 | 1/1992 | Detweiler et al. | 123/520 |
| 5,277,167 | 1/1994 | DeLand et al. | 123/518 |
| 5,429,099 | 7/1995 | DeLand et al. | 123/520 |
| 5,551,406 | 9/1996 | Everingham et al. | 123/520 |
| 5,687,697 | 11/1997 | Ishikawa | 123/520 |
| 5,816,287 | 10/1998 | Hyodo et al. | 137/587 |

*Primary Examiner*—Denise L. Ferensic
*Assistant Examiner*—Joanne Y. Kim
*Attorney, Agent, or Firm*—Roger A. Johnston

[57] ABSTRACT

A fuel vapor canister purge control valve assembly has an electric valve and a pressure regulator valve for connection at its inlet to a canister fluidically in series in a common housing. The electric valve has a spherical magnetically permeable operator biased closed against the seat by a balanced rotary armature. A C-shaped solenoid pole frame defines diametrally oppositely disposed radial working air gaps with the armature. Upon PWM energization of the solenoid, the armature rotation permits the spherical valve member to move from the seat to open the valve. A venturi is formed in the electric valve inlet and the venturi throat has a pressure tap connected to provide a reference pressure for one side of the pressure regulator diaphragm. The opposite side of the regulator diaphragm has an elastomeric obturator and is exposed to the outlet pressure of the electric valve. The elastomeric obturator is moveable with respect to another valve seat for controlling flow to the outlet for connection to an engine inlet manifold.

28 Claims, 6 Drawing Sheets

CONTROLLING VAPOR FLOW IN A CONDUIT

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to electromagnetically actuated valves and particularly valves of the type employed for controlling flow in a conduit, such as fuel vapor flow from an automotive fuel tank vapor canister to the engine air induction manifold or inlet.

In the control of automotive emissions, it has become necessary to trap fuel tank vapors in a canister, typically filled with granular carbon or charcoal, during periods of engine operation and inoperation. Upon engine start-up, fuel tank vapor is directed to the engine air induction inlet to purge the canister. In order to properly control the flow of fuel vapor from a canister to the engine air inlet during operation, it is necessary that the fuel vapor flow be controlled according to the engine operating conditions and induction air flow to prevent unduly rich fuel mixtures. Heretofore, fuel vapor flow to the engine inlet has in some cases been controlled by control valves operating with engine manifold depression or vacuum employed as a control signal acting on a pressure responsive diaphragm for controlling movement of a valve obturator.

An electrically operated valve has also been employed to control an atmospheric bleed to create a pressure differential for causing the diaphragm to move the valve obturator to control vapor canister purge flow. This technique has been found to have limitations; namely, that for a valve calibrated for normal engine operating flow, under certain conditions such as elevated ambient temperatures vapor pressure in the canister could overcome the force of the diaphragm preload spring and force the valve open during engine shut down. In addition, increases in fuel vapor pressure in the system canister due to high ambient temperatures can cause the valve diaphragm to open the valve more than desired during engine operation which has resulted in overly rich engine fuel-air mixtures, and in some cases engine stalling. Accordingly, it has become desirable to electrically directly control a vapor flow valve for fuel vapor canister purging. It has been desired to provide control of such fuel vapor canister purge flow from a the on-board engine microcontroller according to an algorithm based upon measured engine operating parameters in order to adequately control the flow of vapor to the engine air inlet and prevent an unduly rich mixture and improper engine operation.

Heretofore, electrically operated flow valves employed to control fuel vapor canister purge have employed linear type solenoids. Linearly acting solenoid valves have been subject to sliding friction of the armature which has caused excessive hysteresis. Typically, such valves employ the armature to move an elastomeric valve member for opening and closing against a valve seat. Swelling of the elastomeric material when exposed to fuel vapors and the compression set of the elastomeric material when held against the valve seat or sealing surface for extended periods of time have caused problems in control and the service life of such valves during exposure to the elevated temperatures encountered in motor vehicle engine compartment applications. An example of such a known linear solenoid electrically operated valve is that described in U.S. Pat. No. 5,551,406.

It has thus been desired to provide a low cost, reliable, precision flow control valve for controlling fuel vapors from a canister in a manner which will maintain the proper operation of the engine over the desired speed and load envelope and do so reliably and repeatedly for an extended service life and continue to meet mandatory fuel vapor emission limits.

It has also been desired to provide an automotive fuel vapor canister purge control valve which is resistant to opening under elevated ambient temperatures encountered during periods of engine inoperation which would permit fuel vapor escape through the engine air inlet to which the valve is connected.

BRIEF SUMMARY OF THE INVENTION

It is an object of the present invention to provide a reliable, low cost, electrically operated valve with integral or "built-in" pressure regulator for controlling flow in a conduit which is robust when exposed to a severe environment such as an automotive engine compartment and which can maintain complete and accurate control of flow for an extended service life.

It is a further object of the present invention to provide an electromagnetically actuated valve suitable for motor vehicle engine fuel vapor canister purge flow control which provides accurate and repeatable flow control and is resistant to vibrations and to reduce operating hysteresis and permanent set of the valve material over prolonged periods of exposure to a valve closed condition.

The present invention provides a self-contained valve assembly having an electromagnetically operated valve fluidically in series with a pressure regulated valve operated by a pressure responsive diaphragm. One side of the diaphragm is referenced to the static pressure in the throat of a venturi formed in the inlet of the electromagnetically operated valve.

The present invention employs an electromagnetically actuated valve wherein a rotary armature is energized equally on opposite sides of its center of rotation by oppositely disposed magnetic poles of a solenoid across oppositely disposed radial air gaps; and, the armature acts against a spherical valve member formed of rigid preferably magnetically permeable material for controlling flow over an annular valve seat. The rotary armature is balanced insofar as forces due to friction and vibration acting on the assembly and thus provides improved sensitivity to the electromagnetic forces generated by the solenoid resulting in improved flow control in response to an electrical control signal, which in the preferred practice is a pulse width-modulated signal.

DETAILED DESCRIPTION OF THE INVENTION

Figure 3:
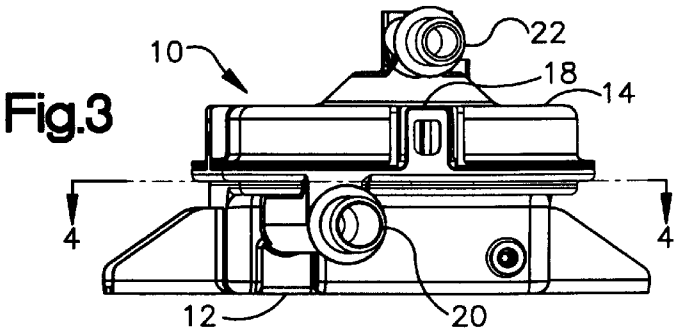
FIG. 3 is a left-hand elevation view of the assembly of FIG. 1.

Referring to FIGS. 1 through 11, the valve assembly of the present invention is indicated generally at 10 and includes a lower housing shell 12 enclosed by a cover 14 releasably attached by a plurality of suitable snap locking by barbs 16 formed on the cover and correspondingly located deflectable snap tabs 18 formed on the housing 12.

A fluid vapor inlet fitting 20 is formed in the housing 12; and, a fluid vapor outlet fitting 22 is formed in the cover 14, both of which have annular barbs or ribs thereon and are adapted for connection to a flexible conduit (not shown) such as an elastomeric tubing. In the presently preferred practice of the invention in which the valve is employed for controlling fuel vapor purge flow from a canister in a motor vehicle application, fitting 20 is connected to the canister 17 and fitting 22 is connected to the engine air induction manifold inlet 19. It will be understood that in a typical automotive fuel vapor canister purge application, fitting 22 discharges to subatmospheric pressure or vacuum of the engine induction inlet; however, it will be understood that the valve may be employed in other applications wherein a positive pressure is applied to the inlet fitting 20 and fitting 22 is exposed to atmospheric pressure.

Referring to FIGS. 1, 2, 6 and 10, the cover 14 has an electrical connector indicated generally at 24 mounted thereon which will hereinafter be described in greater detail and which is adapted for electrical connection to a source 29 of electrical control signal, which in the presently preferred practice is of the variable duty cycle type. The control signal is intended to be modulated between zero and 100% duty cycle and is preferably of the pulse width-modulated (PWM) type and preferably conditioned as a constant current driver. Such a control signal is typically generated by the engine electronic controller in an automotive fuel vapor canister purge flow control system application.

Referring to FIGS. 1 through 9, inlet fitting 20 has a passage 21 formed therethrough and communicates with an electromagnetically operated flow control valve subassembly indicated generally at 25 which has an annular valve seat 26 formed in an annular seat member 28 received in the end of passage 21 and sealed therein by a seal ring 30. A moveable valve member 32 preferably having a spherical configuration is registered against valve seat 26 for movement with respect thereto as will hereinafter be described.

In the presently preferred practice, spherically configured valve member 32 is formed of material of relatively high magnetic permeability, such as AISI type 440-C stainless steel.

It will be understood that the inlet passage 26 converges to a reduced diameter throat region 27 thus forming a venturi.

Figure 8:
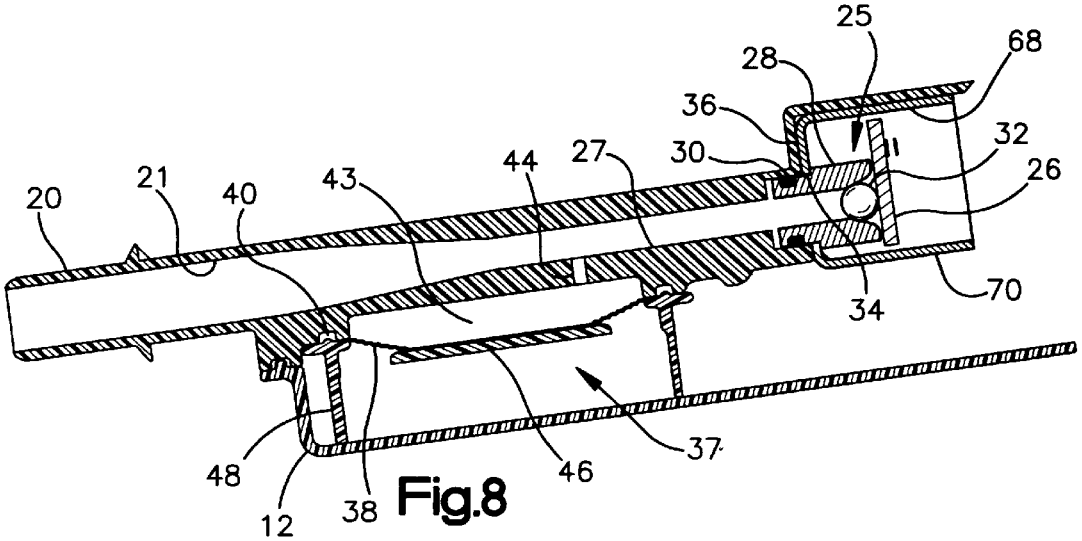
FIG. 8 is a partial section view taken along section indicating lines 8—8 of FIG. 1.
Figure 10:
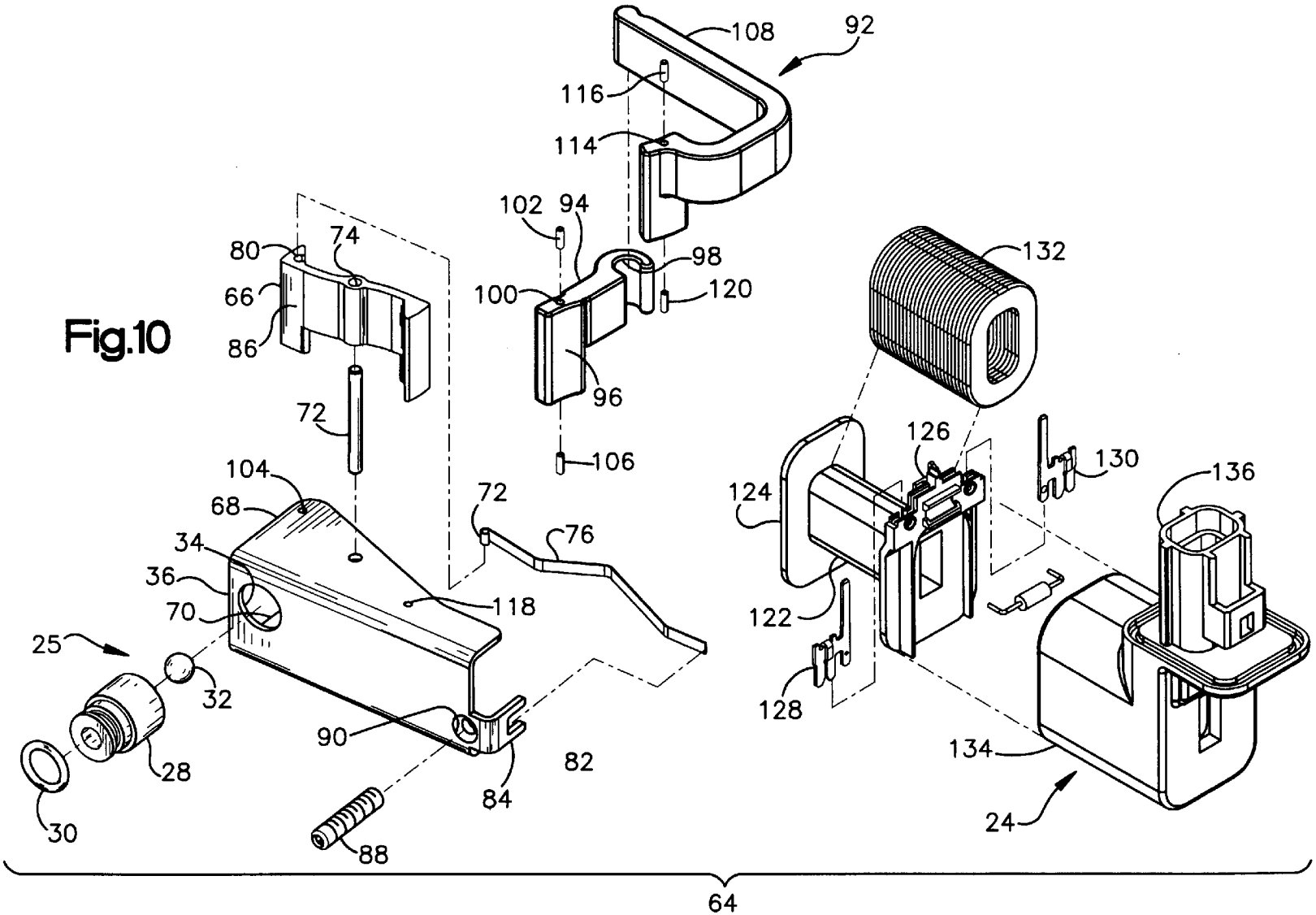
FIG. 10 is an exploded view of the solenoid assembly of the valve of FIG. 1.

In the presently preferred practice of the invention, the seat member 28 is received through an aperture 34 formed in an armature mounting bracket 36 having a generally U-shaped configuration in transverse section as shown in FIGS. 8 and 10.

A pressure regulator valve subassembly is indicated generally at 37 and includes a flexible diaphragm 38 which has a rim flange 40 formed about the periphery thereof and which is sealed to an adhesive sealant containing annular groove 42 formed in the lower housing shell 12 to form a closed chamber 43 therein which is referenced to the pressure in the inlet passage 26 by a relatively small bleed orifice or passage 44 formed in the wall of the inlet passage 26 and which is ported to the throat 27 of a venturi formed therein.

Figure 9:
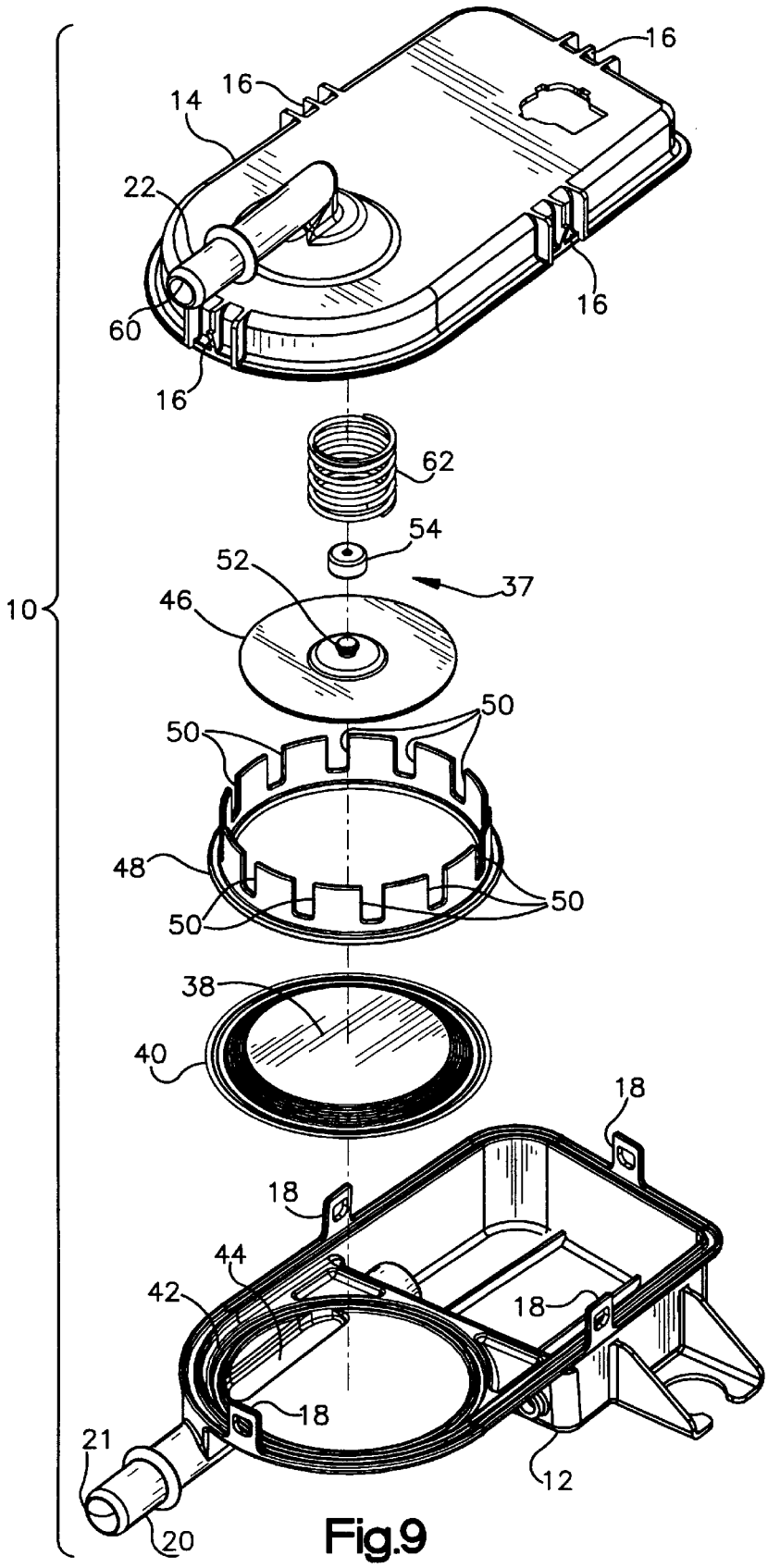
FIG. 9 is an exploded view of the assembly of FIG. 1 with the solenoid removed.

The rim flange 40 of the diaphragm is pressed into the sealant in groove 42 and sealed therein by the rim flange of an annular spacer member or ring 48 which has the upper end thereof castellated at 50 as shown in FIG. 9 and which is sandwiched between the diaphragm and the undersurface of cover 14.

The diaphragm has a centrally disposed rigid backing plate 46 which has formed centrally thereon an upstanding post 52 undercut or flanged which has received thereover in positive engagement therewith an annular resilient cap 54 preferably formed of elastomeric material and which forms a valving obturator.

The cover 14 has formed therein a valving tower 56 which extends upwardly at right angles to the diaphragm backing plate 46 and which has a passage 58 formed therein which communicates with passage 60 provided in outlet fitting 22. The upper end of tower 56 forms a valve seat against which is registered for closure the face of the obturator 54.

The backing plate 46 and obturator 54 are biased away from the valving tower 56 by a spring 62 which has one end registered against the surface of backing plate 46 with the other end registered against the undersurface of cover 14.

It will be understood that the castellations 50 of ring 48 provides passages for fluid communication between flow valve 25 and pressure regulator valve 37. In one embodiment the pressure regulator diaphragm has an effective area of 4.9 inches$^2$ (31.6 $cm_2$); and, the regulator spring has a spring rate of about 22 pounds per inch (3.9 Kg/cm).

Figure 4:
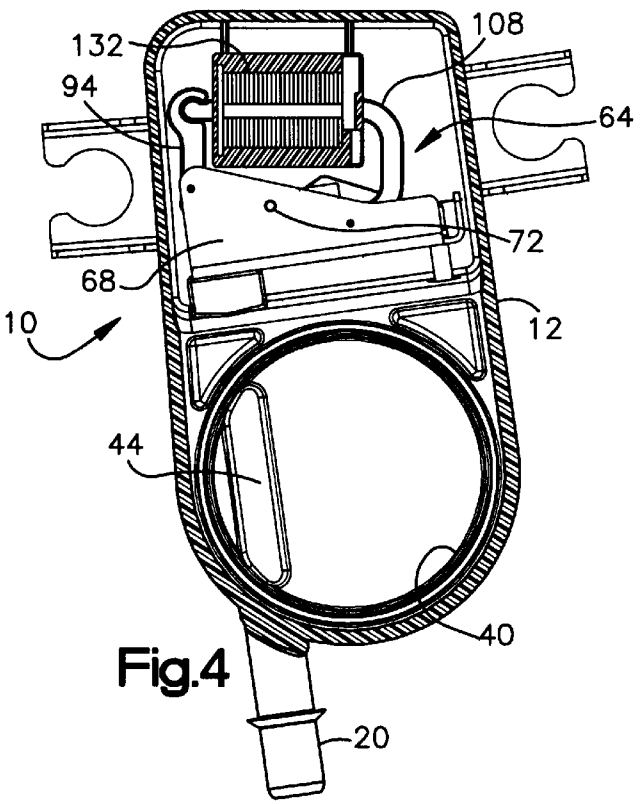
FIG. 4 is a section view taken along section indicating lines 4—4 of FIG. 3.
Figure 1:
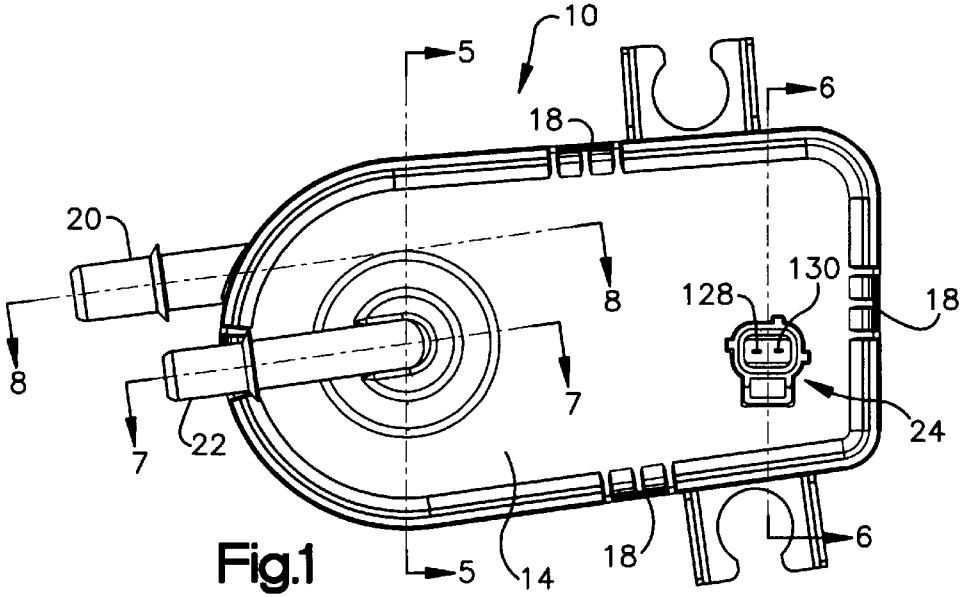
FIG. 1 is a plan view of the electrically operated valve assembly of the present invention.
Figure 2:
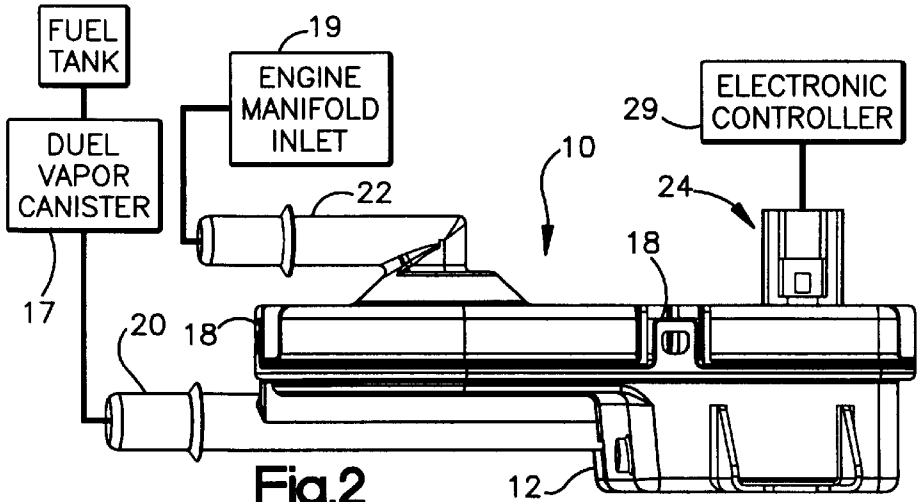
FIG. 2 is a front elevation view of the assembly of FIG. 1.
Figure 5:
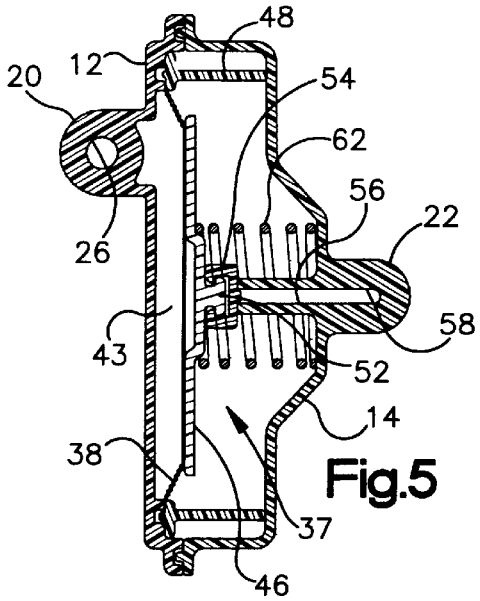
FIG. 5 is a section view taken along section indicating lines 5—5 of FIG. 1.
Figure 6:
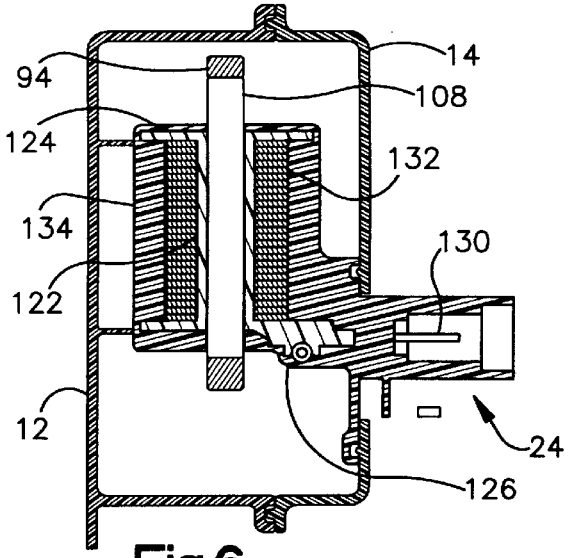
FIG. 6 is a section view taken along section indicating lines 6—6 of FIG. 1.
Figure 7:
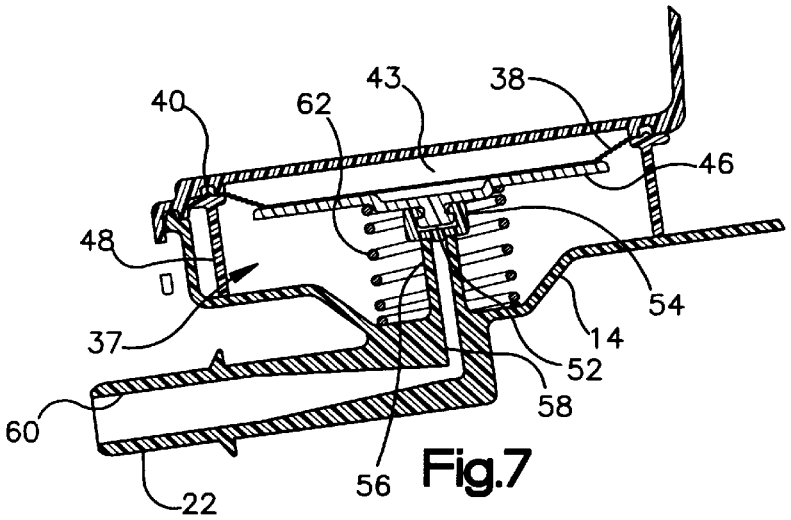
FIG. 7 is a partial section view taken along section indicating lines 7—7 of FIG. 1.
Figure 11:
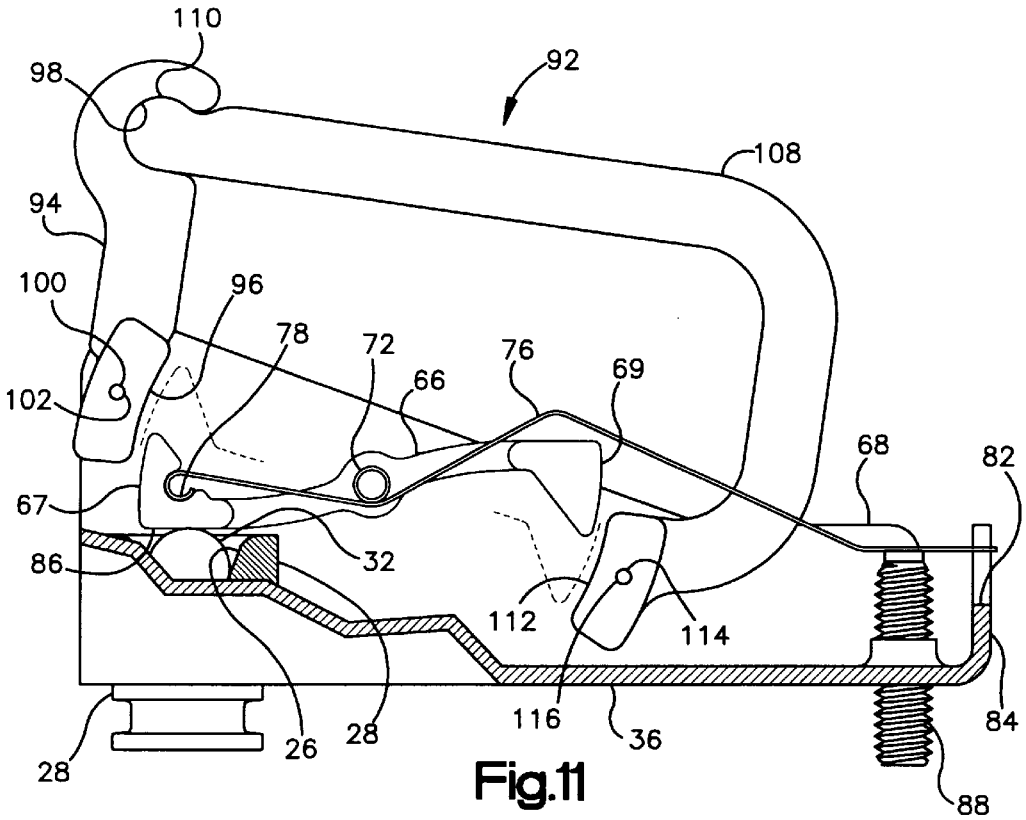
FIG. 11 is an enlarged detail of the armature sub-assembly of the valve of FIG. 1.

Referring to FIGS. 4, 10, and 11, the electromagnetic actuator assembly for valve 25 is indicated generally at 64 and includes an armature 66 having a generally S-shaped configuration in transverse section and which is pivotally mounted about a pin 72 between the upper and lower flange 68, 70 of mounting bracket 36 by pin 72 which passes through central aperture 74 in the armature with the ends of the pin engaged in apertures formed in the flanges 68, 70 of bracket 36. One such aperture is shown in bracket 68 in FIG. 10 and is denoted by reference numeral 75, it being understood that the corresponding aperture for pin 72 provided in the lower bracket flange 70 is hidden from view in FIG. 10. The armature is thus free to rotate about the pin 72 between the bracket flanges.

A beam spring 76 has one end thereof curled or rolled to form a retainer thereon as denoted by reference numeral 78, which retainer is slidably received in an undercut groove 80 formed in one end of the armature 66. The opposite end of the beam spring 76 is slidably received in a slot 82 formed in a tab 84 provided on the end of bracket 36. The spring 76 is arranged and disposed to bias the armature 66 in a counter-clockwise direction in plan view or as viewed from above in FIG. 10. The end of the armature adjacent groove 80 has a surface 86 formed thereon which contacts the spherical valve member 32 and holds the valve closed against the annular valve seat 26 when the electromagnetic actuator 64 is de-energized. An adjustment screw 88 is threadedly engaged in an aperture 90 formed in the bracket 36 and serves to provide adjustment for the preload torque on the armature by moving the end of the spring in slot 82.

It will be understood that the valve member 32 is otherwise free floating, but is magnetically attracted to the armature during energization of the electromagnetic operator for valve 25; and, thus "flutter" of valve 25 is eliminated.

Referring to FIGS. 10 and 11, a magnetic pole frame assembly indicated generally at 92 comprises a first magnetic pole piece 94 having a shoe surface 96 disposed adjacent the end 67 of armature 66 defining a radial air gap therebetween and has an undercut groove 98 formed in the opposite end thereof. The first pole piece 94 has an aperture formed at the opposite vertical ends of pole face 96, one of which is visible in the drawings and denoted by reference numeral 100; and, pole piece 94 is secured to the bracket 36 by a pin 102 having one end received in the aperture 100 with the opposite end received through a corresponding aperture 104 provided in the bracket 36. A similar pin 106 is received in an oppositely disposed aperture (not shown) in the pole piece and is registered in a corresponding hidden aperture in the lower flange 70 of the bracket.

A second pole piece 108 having a generally J-shaped configuration has a cylindrical knob 110 formed on the end of the longer leg thereof which knob portion is slidably received in groove 98 in the first pole piece 94 in positive engagement therewith. The end of the second pole piece 108 adjacent the shorter leg thereof has a pole face 112 which is spaced adjacent the end 69 of the armature to form a radial air gap therewith. The pole piece 108 has apertures provided in the vertical faces thereof adjacent the pole face 112, one of which apertures is illustrated in the drawings and denoted by reference numeral 114. A pin 116 has one end thereof received in aperture 114 with the opposite end thereof engaging a correspondingly located aperture 118 formed in the bracket 36 in the upper flange 68 thereof. It will be understood that a corresponding hidden aperture is formed in the lower surface of the pole face 112 of pole piece 108 and a pin 120 has one end thereof received in the unshown aperture with the opposite end of the pin engaging a correspondingly located but unshown aperture formed in the lower bracket flange 70. The foregoing arrangement thus anchors the two pole pieces, when engaged, as a rigid C-shaped pole frame with the pole faces 96, 112 disposed diametrally opposed to the ends 67, 69 respectively of the rotatable armature 66. It will be understood that spherical valve member 32 is also magnetically slightly attracted to pole face 96 which aids in reducing "flutter".

Referring to FIGS. 4 and 10, a solenoid coil bobbin 122 has a pair of spaced end flanges 124, 126 with one end flange configured to have a pair of electrical terminals 128, 130 pressed in grooves formed in the flange 126. A coil 132 of magnet wire is provided and would on the bobbin 122; however, the coil is illustrated separately in FIG. 10, it being understood that the coil is actually wound on the bobbin 122. In one embodiment of the invention, the coil comprises 2000 turns of number 29 gauge magnet wire. A cover 134 is disposed over the bobbin; and, the terminals 130, 128 extend through a receptacle shell 136 provided on the cover 134 to permit external electrical connection to the coil. It is understood that each of the terminals 128, 130 has one end of the coil 132 connected respectively thereto. It will be understood that cover 134 is formed by encapsulation rather than assembly of a separate part.

It will be understood that pole piece 108 is assembled through the hollow of bobbins 122 with the coil already wound thereon and then the end 110 thereof assembled into groove 98 of pole piece 94. The subassembly of the coil bobbin and pole frame is then pinned to bracket 36. This arrangement has been found to provide accurate control of the dimension of the assembly and aids in precisely controlling the air gaps.

In the presently preferred practice, the surfaces 96, 67 and 69, 112 are configured such that with the armature in the position shown in FIG. 11 with the actuator deenergized, the radial air gaps each have a value of about 0.040 inches (1 mm); and, in the fully energized or rotated position of the armature shown in dashed outline in FIG. 11, the air gap is tapered to about 0.010 inches (0.25 mm). In the presently preferred practice of the invention, the armature is rotated through an angled $\Delta\Theta=14°$ full stroke and utilizes about 8° of rotation for operation with a 100% duty cycle control signal.

In operation, upon energization of the coil 132, armature 66 is caused to rotate by the forces of magnetic attraction in a clockwise direction to overcome the force of spring 76 and permit the ball valve 32 to open against valve seat 26. The amount of movement of the armature is determined by the percentage of "on" time of the control signal or the fraction of the duty cycle with 100% duty cycle representing full opening of the valve.

It will be understood that in order to balance the armature about the pin 72, a slight increase in mass of the armature end opposite face 86 may be required to compensate for the effect of the mass of the valve member 32 as it moves with the armature. This mass balancing of the armature and valve member 32 about pin 72 minimizes movement of the valve 32 under vibration.

In the presently preferred practice of the invention, a radial air gap between the ends 67, 69 of the armature and the pole faces 96, 112 is preferably in the range 0.030 inches (0.76 mm) to a minimum of 0.015 inches (0.38 mm), thus in the present invention, both oppositely disposed radial air gaps are working air gaps in the electromagnetic actuator.

In one embodiment of the invention, a venturi throat diameter for the passage 27 has a diameter of 0.182 inches (4.6 mm) with a 0.21 inches (5.5 mm) diameter obturator 32; and, the flow characteristics have been determined for a beam spring 76 having a spring rate of about 50 grams per millimeter.

An advantage of the rotary armature for the electromagnetic actuator of the present valve is that during rotation of the armature one air gap decreases as the other increases, resulting in minimal change of the total permeance of the magnetic circuit and thus minimal side loading on the bearings, thereby reducing friction. The armature of the rotary solenoid of the present valve assembly is counterbalanced insofar as rotary inertia is concerned thereby minimizing the effects of vibration on the opening of the valve.

Figure 12:
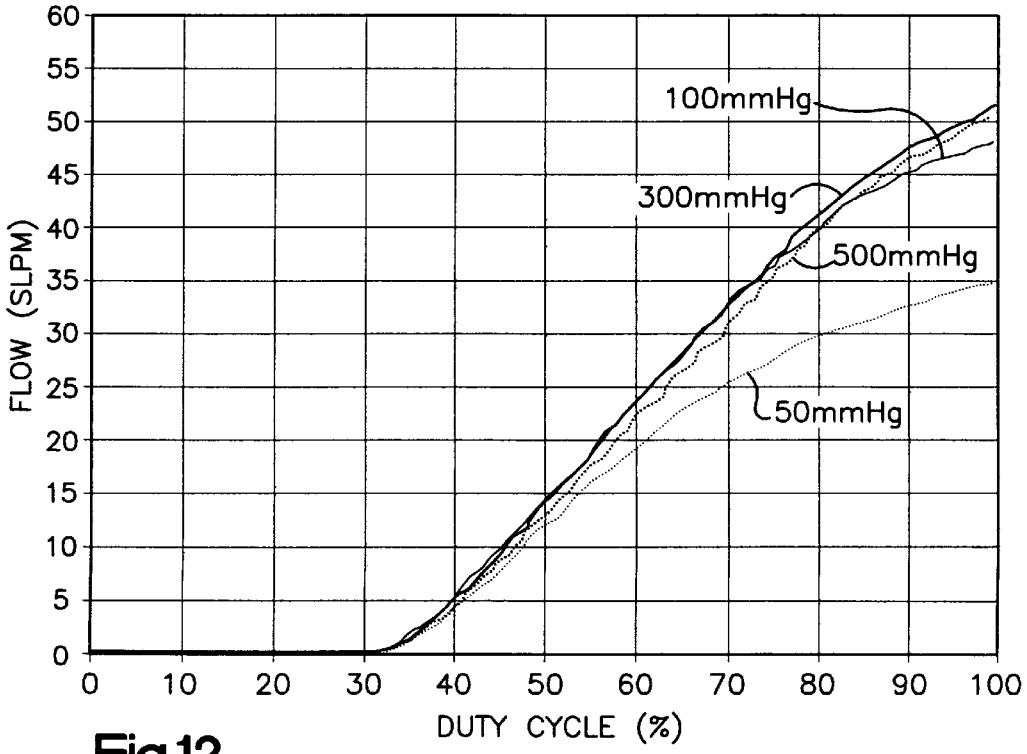
FIG. 12 is a graph of the flow through the valve of FIG. 1 plotted as a function of the fractional duty cycle electrical signal for various values of sub-atmospheric pressure at the valve outlet.

Referring to FIG. 12, a valve having the foregoing characteristics was tested with the electrical signal varying from zero to 100% duty cycle and the valve flow measured for each of several sub-atmospheric pressures applied to the outlet. The graphical plots for each level of vacuum applied to the outlet are shown in graphical form in FIG. 12. It will be apparent in FIG. 12 that at low levels of vacuum applied to the outlet, simulating high engine operating load, the flow through the valve at 100% duty cycle is somewhat diminished.

Figure 13:
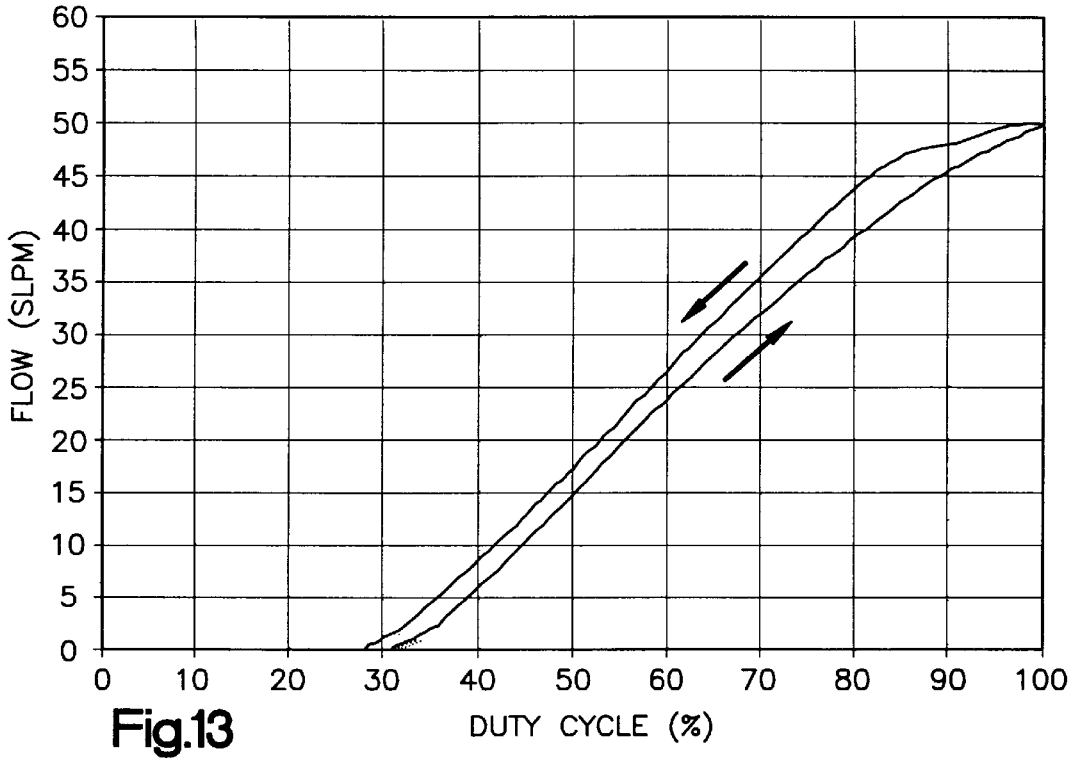
FIG. 13 is a graph of flow through the valve assembly of FIG. 1 plotted as a function of the fractional duty cycle electrical signal showing the hysteresis upon increasing electrical signal from zero to 100% and decreasing the signal from 100% to zero; and, FIG. 14 is a graph of flow through the valve assembly of FIG. 1 plotted as a function of fractional duty cycle control signal for diaphragm referenced to inlet venturi throat pressure and for the diaphragm referenced to atmospheric pressure.

Referring to FIG. 13 the minimal hysteresis in flow, experienced in cycling the valve from zero to 100% to a duty cycle of the control signal is illustrated graphically in a plot of flow as a function of control signal duty cycle.

Figure 14:
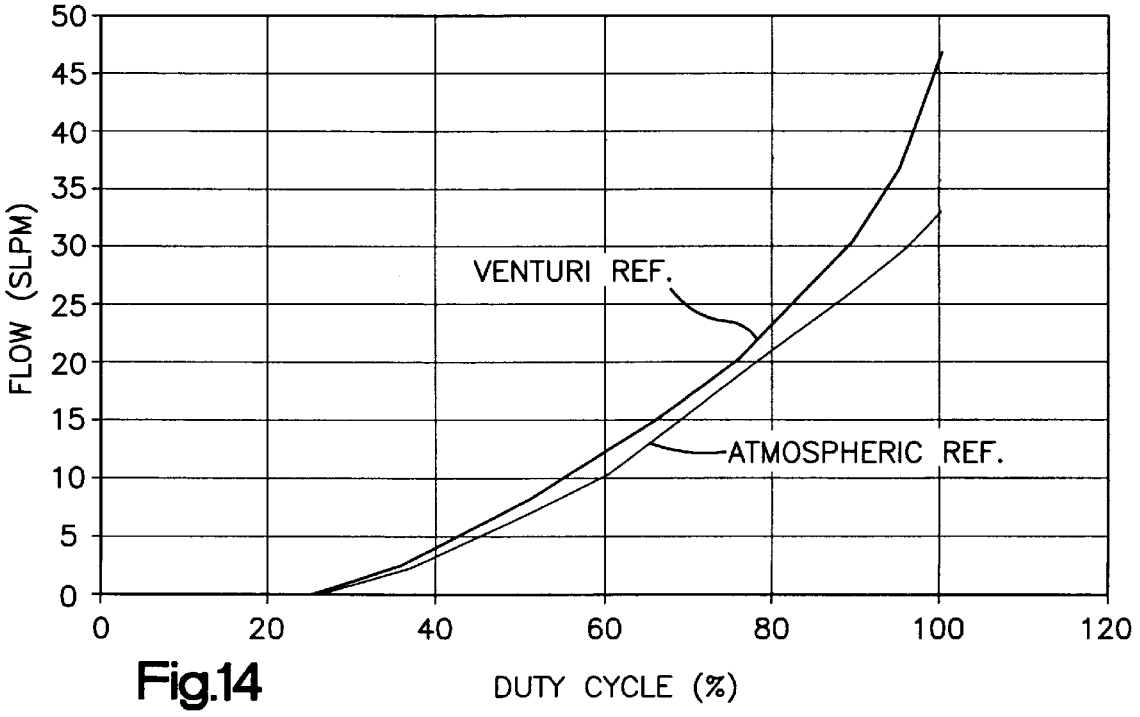

Referring to FIG. 14, the effect of the venturi throat pressure referencing of the pressure regulator diaphragm is shown wherein the upper curve shows the flow characteristics of the valve with the bleed port 72 referencing the diaphragm 38 to the inlet venturi throat pressure. The bleed hole 44 tap to the venturi throat thus references the regulator to flow rate in the inlet which gives a greater negative pressure on the diaphragm as flow increases which causes the regulator to increase flow. This results in a steeper slope to the flow curve as shown in FIG. 14, which in turn provides increased resolution and better control of flow rates. It will be understood than in fuel vapor canister purge applications low flow rates are used when vapor concentration is high. The lower curve of FIG. 14 illustrates the flow through the valve as a function of the chamber vacuum in the housing with the bleed hole 72 plugged and the diaphragm referenced to atmospheric pressure through a separate bleed hole (not shown) provided in the housing 12 for purposes of the test.

The present invention thus provides a unique low cost, reliable and robust electrically operated flow control valve with integral pressure regulator which is particularly suitable for flow control with the outlet connected to a subatmospheric pressure or vacuum such as encountered in applications for controlling flow of fuel vapor canister flow to an engine induction air inlet. The assembly includes an electrically operated valve fluidically in series with a diaphragm operated pressure regulator valve with the diaphragm referenced to the throat pressure of a venturi provided in the inlet of the electrically operated valve. The electrically operated valve employs a rotary solenoid with a pair diametrally opposed working radial air gaps between the poles and the armature. The rotary armature is biased against a magnetically permeable floating valve obturator which is attracted magnetically to the armature and first pole to minimize flutter. The electrically operated valve is responsive to a variable control signal such as a PWM signal.

Although the invention has hereinabove been described with respect to the illustrated embodiments, it will be understood that the invention is capable of modification and variation and is limited only by the following claims.

We claim:

1. An electromagnetically operated valve assembly comprising:

(a) housing structure defining a fluid inlet communicating with a valve seat and an outlet port downstream of said valve seat:

(b) a first valve obturator disposed for movement between a position preventing fluid flow over said seat and at least one position permitting flow over said seat;

(c) a second valve obturator downstream of said valve seat and means responsive to the fluid pressure in said inlet reaching a pre-selected level for effecting movement of said second obturator and preventing flow to said outlet;

(d) an armature associated with said housing structure disposed for rotation with respect thereto, said armature operative upon said rotation to effect said movement of said first obturator;

(e) electromagnetic means operative upon selective electrical energization to effect said movement of said first obturator to a predetermined position with respect to said valve seat; and, (f) means biasing said first obturator to one of said preventing flow position and said at least one position permitting flow.

2. The valve assembly defined in claim 1, wherein said means responsive to fluid pressure includes a flexible diaphragm.

3. The valve assembly defined in claim 1, wherein said first obturator has a spherical configuration.

4. The valve assembly defined in claim 1, wherein said means biasing said first obturator includes a torsion spring.

5. The valve assembly defined in claim 1, further comprising means applying a preload to said pressure responsive means.

6. The valve assembly defined in claim 1, wherein said housing structure includes a solenoid coil and a "C" shaped magnetic pole frame defining a pair of oppositely disposed radial air gaps with said armature.

7. The valve assembly defined in claim 1, wherein said housing structure includes an inlet chamber having a portion of the boundary thereof formed by said pressure responsive means; and, said chamber includes a passage communicating with said valve seat.

8. The valve assembly defined in claim 1, wherein said inlet and outlet are aligned.

9. The valve assembly defined in claim 1, wherein said second obturator has a generally disc shaped configuration.

10. The valve assembly defined in claim 1, wherein said housing structure includes a solenoid coil a "C"-shaped magnetic pole frame defining a pair of oppositely disposed radial air gaps with said armature; and, rotation of said armature progressively decreases said air gap.

11. A method of controlling flow in a conduit comprising:

(a) disposing an inlet and outlet conduit in a housing structure and dividing the interior of said housing with a pressure responsive member into an inlet and outlet chamber communicating respectively with said inlet and outlet conduit;

(b) disposing a valve member for movement with respect to a valve seat communicating between said inlet chamber to said outlet chamber;

(c) disposing an armature for rotary movement on said housing and connecting said armature to said valve member and effecting movement thereof by said rotary movement;

(d) disposing an electrical operator on said housing and electromagnetically effecting said rotary movement of said armature;

(e) moving said pressure responsive member and closing said outlet at a threshold level of differential pressure between said inlet and outlet chamber.

12. The method defined in claim 11, wherein said step of moving said pressure responsive member includes preloading said pressure responsive member.

13. The method defined in claim 11, wherein said step of disposing said armature includes biasing said rotary movement in one direction.

14. The method defined in claim 11, wherein said step of electromagnetically moving includes disposing a coil and generally "C" shaped pole frame on said housing and forming a pair of oppositely disposed radial air gaps with said armature.

15. The method defined in claim 11, wherein said step of disposing an inlet and outlet conduit includes aligning said inlet and outlet conduit.

16. The method defined in claim 11, wherein said step of disposing an electrical operator includes forming a pair of oppositely disposed radial air gaps with said armature.

17. The method defined in claim 11, wherein said step of disposing an electrical operator includes forming a pair of oppositely disposed radial air gaps with said armature and decreasing said air gaps progressively upon rotation of said armature.

18. A method of controlling fuel vapor flow from a vapor canister to the inlet manifold of an engine comprising:

(a) connecting the inlet of an electrically operated valve to the canister, and connecting the outlet of said valve to the inlet of a pressure regulator valve operated by a pressure responsive member and connecting the outlet of said regulator valve to said inlet manifold;

(b) forming a venturi in the inlet of said electrically operated valve and providing a pressure tap in the venturi throat;

(c) connecting said pressure tap to one side of said pressure responsive member; and, (d) energizing said electrically operated valve with a variable control signal and moving a valve obturator and providing flow to said pressure regulator valve and to said inlet manifold.

19. The method defined in claim 18, wherein said step of moving an obturator includes electromagnetically moving said obturator.

20. The method defined in claim 18, wherein said step of moving an obturator includes electromagnetically rotating an armature.

21. The method defined in claim 18, wherein said step of moving an obturator includes preloading a rotating armature against said obturator and electromagnetically overcoming said preload.

22. The method defined in claim 18, wherein said step of connecting the outlet of said electrically operated valve to the inlet of said pressure regulator valve includes disposing said valves in a common housing.

23. An electrically operated fluid flow control valve assembly comprising: (a) housing structure having therein a first electrically operated valve having an inlet and outlet and a second pressure regulator valve operated by a pressure responsive member and having an inlet and outlet, said first and second valves fluidically in series with the outlet of said first valve connected to the inlet of said second valve, wherein the inlet of said first valve is adapted for connection to a source of fluid and the outlet of said second valve is adapted to discharge said fluid; (b) a venturi having a throat disposed in the inlet of said electrically operated valve and a pressure tap in said throat wherein said pressure tap is connected to provide a pressure reference for one side of said pressure responsive member and the side opposite said one side is exposed to the outlet pressure of said electrically operated valve; and, (c) means biasing said first valve closed, wherein upon variable electrical energization thereof said first valve is opened accordingly to permit flow to said second valve and said second valve provides said discharge.

24. The valve assembly defined in claim 23, wherein said first valve includes an obturator moveable with respect to a valve seat and a rotatable armature biased to hold said obturator against said seat; and, electromagnetic means operable upon said energization to overcome said bias and move said obturator from said seat.

25. The valve assembly defined in claim 23, wherein said first valve includes an obturator moveable with respect to a valve seat downstream of said throat, and a rotatable balanced armature biased to hold said obturator against said seat, wherein said obturator is formed of magnetically permeable material; and, electromagnetic means operable upon energization to overcome said bias and move said obturator from said seat.

26. The valve assembly defined in claim 23, wherein said first valve includes a valve seat downstream of said venturi throat and a spherical valve member biased against said seat by a rotatable armature and electromagnetic means operable upon energization to overcome said bias and cause said valve member to be moved from said seat.

27. The valve assembly defined in claim 23, wherein said second valve includes an annular valve seat and a valving member moveable with respect to said annular seat by said pressure responsive means.

28. The valve assembly defined in claim 23, wherein said second valve includes an annular valve seat and an elastomeric valve member attached to said pressure responsive for movement with respect to said annular valve seat.

* * * * *